US008650683B2

(12) United States Patent
Parnham

(10) Patent No.: US 8,650,683 B2
(45) Date of Patent: Feb. 18, 2014

(54) PILLOW

(75) Inventor: Leon Parnham, Cheltenham (AU)

(73) Assignee: Parnham Group Pty Ltd, Cheltenham VIC (AU)

( * ) Notice: Subject to any disclaimer, the term of this patent is extended or adjusted under 35 U.S.C. 154(b) by 0 days.

(21) Appl. No.: 13/552,857

(22) Filed: Jul. 19, 2012

(65) Prior Publication Data

US 2013/0031723 A1 Feb. 7, 2013

(30) Foreign Application Priority Data

Aug. 3, 2011 (AU) ..... 2011903107

(51) Int. Cl.
*A47G 9/10* (2006.01)

(52) U.S. Cl.
USPC ..... 5/636; 5/645; 5/639; 5/655.9; 5/657

(58) Field of Classification Search
USPC ..... 5/630, 636, 639, 640, 645, 648, 652, 5/655.3, 655.9, 657
See application file for complete search history.

(56) References Cited

U.S. PATENT DOCUMENTS

| | | | | |
|---|---|---|---|---|
| 6,490,743 | B1 * | 12/2002 | Adat et al. | 5/645 |
| 6,978,502 | B2 * | 12/2005 | Calagui | 5/640 |
| 7,562,405 | B2 * | 7/2009 | Brogan | 5/645 |
| 7,681,263 | B1 * | 3/2010 | Hawkins | 5/640 |
| 2004/0255385 | A1 * | 12/2004 | England | 5/655.9 |
| 2005/0210590 | A1 * | 9/2005 | DiGirolamo | 5/636 |
| 2005/0217029 | A1 * | 10/2005 | Funatogawa | 5/645 |
| 2006/0236460 | A1 * | 10/2006 | Hooper | 5/636 |
| 2009/0199341 | A1 * | 8/2009 | Schantz | 5/645 |
| 2009/0199342 | A1 * | 8/2009 | Delfs | 5/645 |
| 2011/0145994 | A1 * | 6/2011 | Pileggi | 5/655.3 |

* cited by examiner

*Primary Examiner* — William Kelleher
(74) *Attorney, Agent, or Firm* — Fish & Richardson P.C.

(57) ABSTRACT

A pillow has an outer cover having a first side and a second side that define there between a space for receiving pillow filling. First and second partition walls extend between the first side and the second side to divide the space into first, second, and third chambers, respectively. A closable access mechanism provides access to the first, second, and third chambers so that pillow filling can be selectively added to or removed from any of the chambers to adjust the firmness of portions of the pillow.

7 Claims, 1 Drawing Sheet

PILLOW

TECHNICAL FIELD

The present disclosure relates to pillows.

BACKGROUND

Bed pillows are conventionally made in a number of different shapes and forms to provide comfortable support for a person's head when the person is sleeping. Although many pillow designs have been provided to support a person's head in the correct posture, manufacturers have found it difficult to produce a single pillow which can cater for people of different body shape and size.

SUMMARY OF THE DISCLOSURE

According to an embodiment of the present disclosure, there is provided a pillow comprising:

an outer cover having a first side and a second side which define therebetween a space for receiving pillow filling;

first and second partition walls extending between the first side and the second side to divide the space into first, second and third chambers respectively; and a closable access mechanism for providing access to the first, second and third chambers so that pillow filling can be selectively added or removed from any of the chambers to adjust the firmness of portions of the pillow.

In an embodiment, the first, second and third chambers are arranged as two side chambers either side of a central chamber.

The central chamber may be larger than both of the side chambers and one of the side chambers may be larger than the other side chamber. All of the chambers may extend from end to end of the pillow.

In one configuration, the chambers are filled with pillow filling such that the central chamber is less firm than both of the side chambers.

The first partition wall may be of greater height than the second partition wall.

The closable access mechanism may comprise a zip at one end of the pillow which extends across each of the chambers to provide access to each of the chambers.

BRIEF DESCRIPTION OF THE DRAWINGS

Embodiments of the present disclosure will now be described, by way of example only, with reference to the accompanying drawings, in which.

DETAILED DESCRIPTION OF EMBODIMENTS

Figure 1:
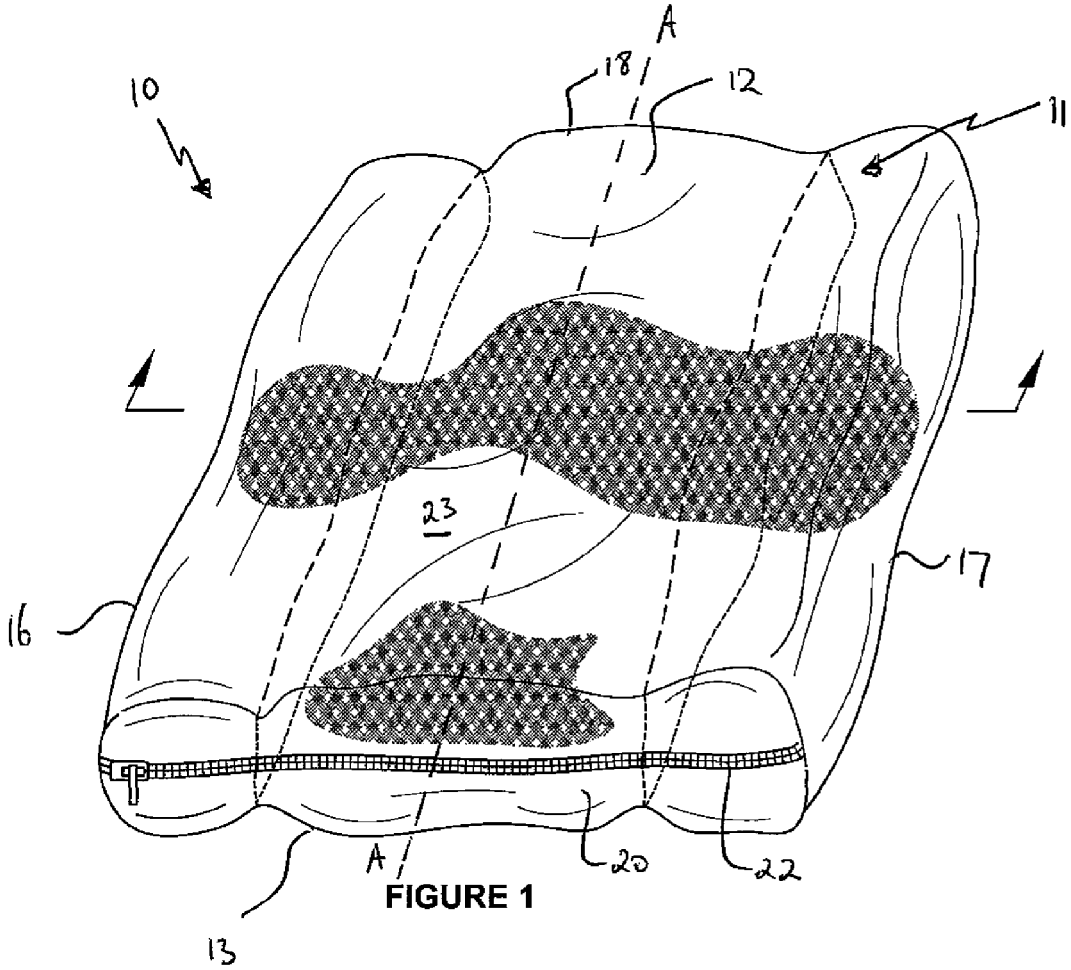
FIG. 1 is a perspective view of a pillow according to an embodiment of the present disclosure.

Referring to the Figures, a pillow 10 is shown which comprises a cover 11 having a first side 12 and a second side 13 which may be joined along first and second longitudinal edges 16, 17 by stitching and along one transverse end 18 also by stitching. Alternatively, instead of stitching both of the edges 16, 17, either of these edges could be formed by a fold so that the folded material forms the first side 12 and the second side 14 and is stitched at the other of these edges to form the pillow. In a further arrangement, the folds could be at the transverse end 18 and the two edges 16, 17 could be stitched.

The other transverse end 20 of the pillow is provided with a closable access mechanism in the form of a zip 22 to seal the pillow and to thereby define a space 23 within the pillow in which pillow filling is provided to form the contour of the pillow. The pillow filling may be any suitable filling material including natural materials such as down, feathers, cotton and wool and synthetic materials such as foam and latex.

First and second internal partition walls 30, 31 are each sewn between the first and second sides 12, 14 of the cover 11. The first and second partition walls 30, 31 are generally parallel to each other and laterally offset from a nominal central longitudinal axis of the pillow (indicated on FIG. 1 as axis A-A) so that the first partition wall 30 is closer to the first longitudinal edge 16 than the other edge and the second partition wall 31 is closer to the second longitudinal edge 17. The first and second partition walls 30, 31 divide the pillow into first and second side chambers 32, 33 and a third central chamber 34. Each of the chambers 32-34 extend generally parallel to another across the length of the pillow, that is between the transverse ends 18, 20 of the pillow 18, 20.

The partition walls 30, 31 are configured so that the third central chamber 34 is much wider than the side chambers 32, 33. Furthermore, the second partition wall 31 is of greater height than the first partition wall 30. Because the first and second partition walls are equidistantly spaced from the first and second longitudinal edges respectively, the greater height of the second partition wall 31 means that the second chamber 33 is of greater size than the first chamber 34. The higher second partition wall 31 also enables the second chamber 33 to be taller than the first chamber 32

The partition walls 30, 31 also pull the first and second sides 12, 14 inwardly to define first and second trough portions 35, 36 in each of the sides. The partition walls 30, 31 as a result also define in each of the sides 12, 14 between the first longitudinal edge 16 and the first trough portion 35, and between the first and second trough portions 35, 36 and also between the second trough portion 36 and the second longitudinal edge 17, slightly concave contoured portions 37, 38 and 39 respectively.

In order to provide a pillow of a desired firmness especially in particular portions of the pillow so that a person can use the pillow to support their head in the correct posture, the zip 22 may be undone and pillow filling may be added or removed from any one or more of the chambers 32-34. It is noted that although in the embodiment shown the pillow has only a single zip to provide access to all of the chambers, in other arrangements, the pillow may be provided with a separate zip for each of the chambers so that they can be individually accessed without having to open all of the chambers. In further embodiments, other types of mechanisms for closable access to the chambers may be provided such as press-studs, Velcro, buttons or clips.

Figure 2:
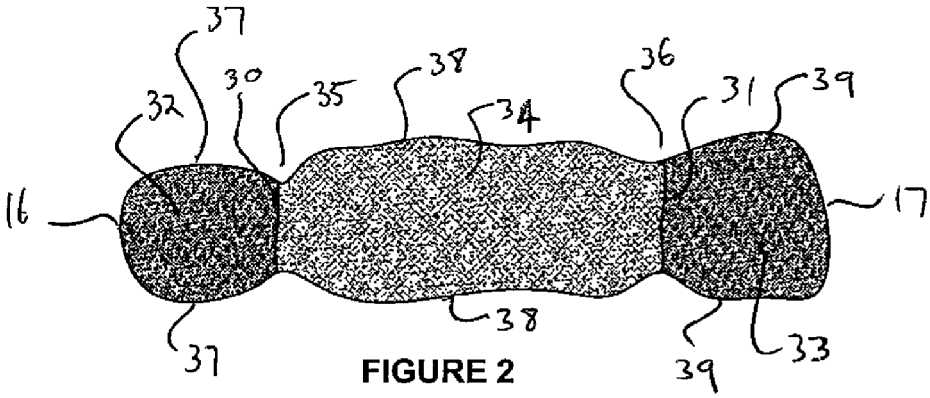
FIG. 2 is a cross-sectional end view of the pillow of FIG. 1.

One configuration of the pillow 10 involves the central chamber 34 being filled so that it is less firm than both of the side chambers 32, 33, as generally indicated in FIG. 2. When a person uses the pillow filled in this configuration, with the side of their head resting on the pillow, the top and bottom of their head are supported by the first and second side chambers 32, 33 of the pillow. The person's ear is over the less firm central chamber 34. The combination of the softer central chamber 34 and the firmness of the side chambers 32, 33 upwardly supporting the top and bottom of the person's head means that there is less pressure on the person's ear. Advantageously, this significantly reduces any "ear crush" experienced by the person using the pillow 10 and enables them to have a much more comfortable sleep. In this configuration, the second side chamber 32 is typically filled so that it is more densely filled or higher than the first side chamber 33. The second side chamber 32 is accordingly positioned under the top of the person's head and the softer and/or shorter first side chamber 33 under the bottom of the person's head and near the person's neck, as this typically provides a more comfortable configuration for the user.

Of course, it is to be understood, that the ability to adjust how much filling material is in each of the chambers 32-34 and accordingly the firmness of those chambers, means that numerous configuration are possible and that the person using the pillow 10 can adopt whatever configuration and particular firmness is suitable for them. Two-chamber pillows have been previously proposed, including in AU663916. However, such pillows do not provide the same level of flexibility as the three chambered pillow of the present disclosure, nor can they properly address the issue of "ear crush" as described above.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A pillow comprising:

an outer cover having a first side and a second side that define therebetween a space for receiving pillow filling;

first and second partition walls extending between the first side and the second side to divide the space into first, second, and third chambers respectively, each of the chambers extending in a longitudinal direction across the pillow; and a closable access mechanism for providing access to the first, second, and third chambers so that pillow filling can be selectively added to or removed from any of the chambers to adjust firmness of the chambers of the pillow;

the first, second, and third chambers being arranged as first and second side chambers, one at each side of the third chamber forming a central chamber spaced from the first side chamber by a first trough and from the second side surface by a second trough, and the central chamber being larger than each of the side chambers and wider in a lateral direction than each of the side chambers, the central chamber defining a central chamber surface, the first side chamber defining a first side surface, the second side chamber defining a second side surface, and the central chamber surface being depressed relative to each of the first and second side surfaces and wherein the first side surface and the second side surface respectively define support surfaces for a head top region and a head bottom/neck region of a user's head, the support surfaces being spaced apart by the central chamber surface and the depressed first and second troughs, and the central chamber surface is depressed relative to the first and second side surfaces.

2. A pillow as claimed in claim 1, wherein one side chamber is larger than the other, opposite side chamber.

3. A pillow as claimed in claim 1, wherein the chambers are filled with pillow filling such that the central chamber is less firm than both of the side chambers.

4. A pillow as claimed in claim 1, wherein all of the chambers extend longitudinally from end to end of the pillow.

5. A pillow as claimed claim 1, wherein the second partition wall is of greater height than the first partition wall.

6. A pillow as claimed in claim 1, wherein the closable access mechanism comprises a zip at one end of the pillow which extends across each of the chambers to provide access to each of the chambers.

7. A pillow as claimed in claim 1, wherein the first trough extends in a longitudinal direction along a region of the first partition wall and the second trough extends in a longitudinal direction along a region of the second partition wall.

* * * * *